US005628250A

United States Patent [19]

Weisbrod

[11] Patent Number: 5,628,250

[45] Date of Patent: May 13, 1997

[54] CHAMBER DOCTOR BLADE ASSEMBLY

[75] Inventor: Norbert G. Weisbrod, Hessheim, Germany

[73] Assignee: Koenig & Bauer-Albert Aktiengesellschaft

[21] Appl. No.: 577,880

[22] Filed: Dec. 22, 1995

[30] Foreign Application Priority Data

Dec. 29, 1994 [DE] Germany ..... 44 47 123.8

[51] Int. Cl.[6] ..... B41F 1/46

[52] U.S. Cl. ..... 101/363; 101/350

[58] Field of Search ..... 101/363, 169, 101/167, 367, 123, 114, DIG. 34, 364, 350, 365, 157, 155, 207–210; 118/261, 262

[56] References Cited

U.S. PATENT DOCUMENTS

| | | | |
|---|---|---|---|
| 4,513,662 | 4/1985 | Schneider | 101/207 |
| 4,584,941 | 4/1986 | Weber | 101/350 |
| 4,796,528 | 1/1989 | Sarazen | 101/208 |
| 4,982,660 | 1/1991 | Hamm et al. | 101/350 |
| 4,989,509 | 2/1991 | Zimmer | 118/262 |
| 4,991,504 | 2/1991 | Fina | 101/363 |
| 5,044,277 | 9/1991 | John | 101/210 |
| 5,150,651 | 9/1992 | Flores | 101/207 |
| 5,388,515 | 2/1995 | Schneider et al. | 101/363 |
| 5,497,702 | 3/1996 | Gorter | 101/366 |

FOREIGN PATENT DOCUMENTS

| | | |
|---|---|---|
| 0111141 | 6/1984 | European Pat. Off. . |
| 0438731 | 7/1991 | European Pat. Off. . |
| 2437584 | 5/1975 | Germany . |
| 3408183 | 3/1985 | Germany . |
| 4241792 | 6/1994 | Germany . |
| 4302671 | 8/1994 | Germany . |

*Primary Examiner*—Edgar S. Burr
*Assistant Examiner*—Anthony H. Nguyen
*Attorney, Agent, or Firm*—Jones, Tullar & Cooper, P.C.

[57] ABSTRACT

A chamber doctor blade assembly includes axially spaced lateral cheeks that seal the ends of the ink reservoir. Each of these lateral cheeks has a sealing face that conforms to the curvature of the screen roller with which the chamber doctor blade is used. These sealing faces are provided with lubricant reservoirs. The lateral faces also have leading edges bent or flared out to form strippers which remove excess beads of ink from the screen roller.

4 Claims, 2 Drawing Sheets

CHAMBER DOCTOR BLADE ASSEMBLY

FIELD OF THE INVENTION

The present invention is directed generally to a chamber doctor blade assembly of an inking unit. More particularly, the present invention is directed to a chamber doctor blade assembly having spaced doctor blades and lateral cheeks or end walls. Most specifically, the present invention is directed to a chamber doctor blade assembly having lateral cheeks with sealing faces provided with at least one depression acting as a lubricant pocket. The chamber doctor blade assembly utilizes a doctor blade base body, in conjunction with spaced working and closing doctor blades, as well as lateral cheeks or end walls to define an ink reservoir. The lateral cheeks are formed having upper sealing faces which are shaped to conform with the curvature of an Avilox or screen roller. The upper surfaces of these sealing faces are provided with depressions which will receive ink from the ink reservoir and will use the ink as a lubricant between the upper surfaces of the sealing faces and the screen roller.

DESCRIPTION OF THE PRIOR ART

In the field of rotary printing, there are various arrangements used to apply the printing ink to the printing cylinder. One such arrangement is a so-called short inking unit. In such a device, the ink is typically held in an ink reservoir that is defined by spaced doctor blades, a base body that supports the doctor blades, and two end plates or lateral cheeks. The lateral cheeks have upper surfaces with arcuate shapes so that they will be closely spaced from the surface of the screen roller and will thus limit seepage of ink from the ink reservoir out along the screen roller beyond the edges of the lateral cheeks.

One chamber doctor blade assembly is shown in European Patent Publication EP 0 438 731 A1. The ink reservoir disclosed in this document is provided with spaced lateral cheeks or end plates. These lateral cheeks are provided with sealing means which can be placed against the surface of a screen roller and which are adapted to the curvature of the surface of the screen roller. These sealing means are made of an elastic material and are coated with a material that has a low coefficient of friction. This low friction material engages the surface of the screen roller and acts to reduce the frictional drag of the lateral cheeks on the screen roller.

A limitation of this prior art device is its cost and complexity. It is necessary to utilize several different coating steps in order to obtain the low-friction contact surface between the sealing means and the screen roller. These coating steps increase the cost of the chamber doctor blade assembly.

In U.S. Pat. No. 5,150,651 there is disclosed a chamber doctor blade that includes spaced doctor blades together with end walls or lateral cheeks. The ink reservoir of this prior art chamber doctor blade is sealed by these lateral cheeks. Each of the lateral cheeks is provided with a depression that acts as a lubricant pocket.

A need exists for a chamber doctor blade assembly which provides an ink reservoir and which overcomes the limitations of the prior art devices. The chamber doctor blade in accordance with the present invention provides such a device and is a significant improvement over the prior art.

SUMMARY OF THE INVENTION

It is an object of the present invention to provide a chamber doctor blade assembly.

Another object of the present invention is to provide a chamber doctor blade assembly having spaced doctor blades and lateral cheeks or end walls.

A further object of the present invention is to provide a chamber doctor blade assembly having lateral cheeks provided with sealing faces having at least one depression acting as a lubricant pocket.

Yet another object of the present invention is to provide a chamber doctor blade assembly for an inking unit of a rotary printing press provided with a screen roller.

Still a further object of the present invention is to provide a chamber doctor blade assembly having sealing faces of its lateral cheeks pressed against the surface of a screen roller.

Even yet another object of the present invention is to provide a chamber doctor blade assembly in which solid body friction between the sealing faces of the lateral cheeks and the screen roller is prevented.

As will be set forth in detail in the description of the preferred embodiments which is presented subsequently, the chamber doctor blade assembly in accordance with the present invention is part of an inking unit of a rotary printing press that includes a screen roller. The chamber doctor blade assembly uses spaced doctor blades, a base body and lateral cheeks or end walls to define an ink reservoir. Each of the lateral cheeks has a sealing face which is adapted in shape to the curvature of the screen roller. Each of these end wall sealing faces has at least one depression which acts as a lubricant pocket and which is in fluid communication with the ink reservoir. Each of these lateral cheeks also has a stripper portion that extends generally perpendicularly with respect to the axis of rotation of the screen roller. These strippers having flared ends that act to remove excess ink from the screen roller in the areas adjacent the lateral cheeks.

The lubricant pockets or depressions in the sealing faces of the lateral cheeks are provided with printing ink from the ink reservoir. This printing ink forms a sealing and lubricating layer between the sealing face of the lateral cheek and the surface of the screen roller. This layer reduces friction between the lateral cheeks and the screen roller and thus very little heat is developed. The wear exerted on the sealing surfaces of the lateral cheeks, as well as the wear experienced by the surface of the screen roller is reduced. This results in increased service life of both elements and reduces the amount of printing press down time.

One particular advantage of the chamber doctor blade assembly in accordance with the present invention is the elimination of gas bubbles in the area of the lateral cheeks. This is due to the fact that very little heat is built up in the area of the lateral cheeks. The elimination of these ink bubbles results in improved irk conveyance by the screen roller and a resultant improvement in the print quality of the printing press.

Another advantage of the present invention is the elimination of elaborate friction linings which are required in the prior art devices. This reduces the cost and complexity of the subject device.

Only a very small amount of printing ink leaves the ink reservoir through the depressions in the sealing faces of the lateral cheeks or end walls. This minimal amount of ink is removed from the screen rollers by the portions of the lateral cheeks which act as strippers. Any residual ink left on the screen roller forms a very small bead of ink. This small bead of ink does not create a problem of ink spraying or slinging as the screen roller rotates.

The chamber doctor blade assembly in accordance with the present invention overcomes the limitations of the prior art. It is a substantial advance in the art.

BRIEF DESCRIPTION OF THE DRAWINGS

While the novel features of the chamber doctor blade assembly in accordance with the present invention will be set forth with particularity in the appended claims, a full and complete understanding of the invention may be had by referring to the detailed description of the preferred embodiments, which is presented subsequently, and as illustrated in the accompanying drawings, in which:

DETAILED DESCRIPTION OF THE PREFERRED EMBODIMENTS

Figure 1:
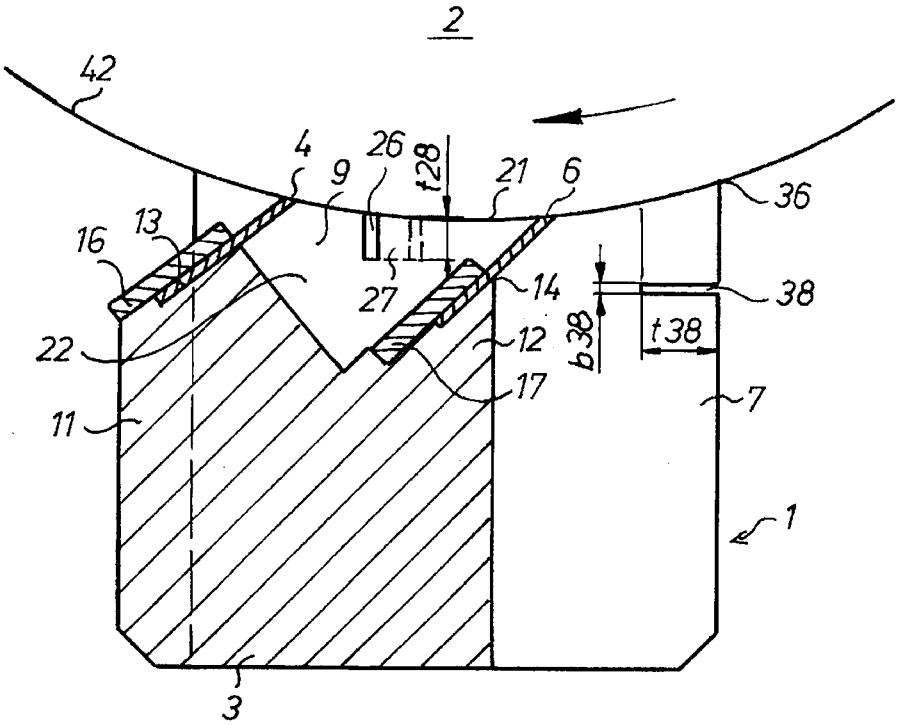
FIG. 1 is a side elevation view, partly in section of a first preferred embodiment of a chamber doctor blade assembly in accordance with the present invention.
Figure 2:
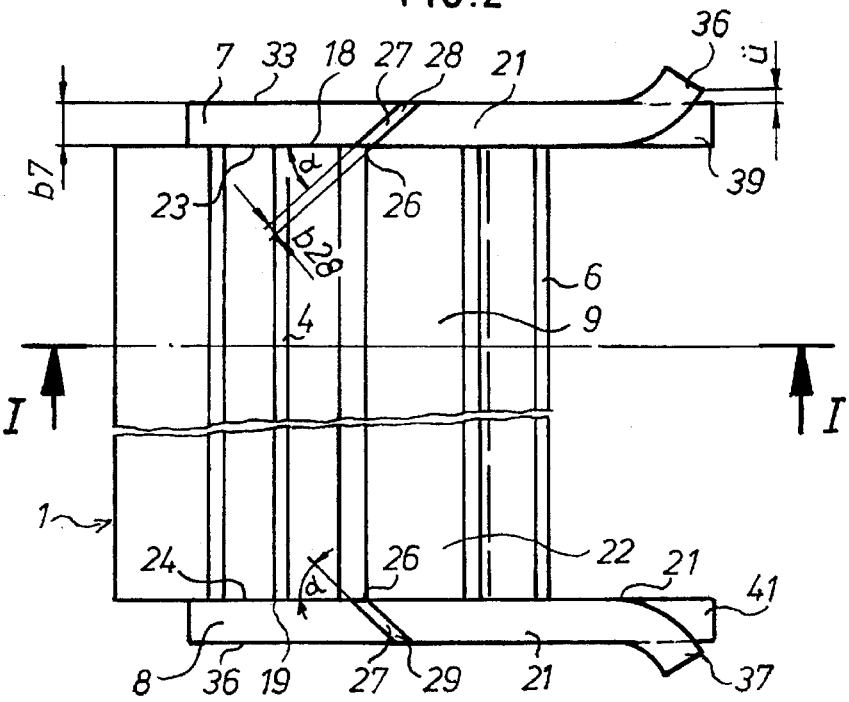
FIG. 2 is a top plan view of the chamber doctor blade assembly of FIG. 1.

Referring initially to FIGS. 1 and 2, there may be seen a first preferred embodiment of a chamber doctor blade assembly, generally at 1, in accordance with the present invention. The chamber doctor blade assembly 1 cooperates with an Avilox or screen roller 2 of a short inking unit. The chamber doctor blade assembly 1 extends axially parallel with the screen roller 2. Several similar chamber doctor blade assemblies 1 can be disposed next to each other. For example, two chamber doctor blade assemblies 1, each extending over half a screen roller width, can be placed adjacent each other. Individual chamber doctor blade assemblies 1, each having the width of a printing plate, for example, can also be provided in order to use several ink colors on the screen roller 2 or to cut off the ink supply by zones.

The chamber doctor blade assembly 1 essentially consists of a base body 3, a work doctor blade 4, a closing doctor blade 6, and right and left lateral cheeks or end walls 7 and 8. The base body 3 is provided with a depression or receptacle 9 and its upper surfaces 11 and 12 close to the screen roller 2 have fastening faces 13 and 14, which are inclined with respect to a radial direction of the screen roller 2. The work doctor blade 4 and the closing doctor blade 6 are clamped against these fastening faces 13 and 14 by fastening strips 16 and 17, respectively, by means of screws or other suitable fasteners. The base body 3 can be formed in one piece, as in the depicted preferred embodiments. Alternatively, base body 3 can also be made of several parts. For example, base body 3 can be divided into two pieces in the axial direction. The lateral cheeks or end walls 7 and 8 are positioned on axially limiting end faces 18 and 19, respectively, of the base body 3 and have respective sealing faces 21 facing the screen roller 2. These sealing faces 21 are each provided with a radius of curvature that conforms to the radius of the screen roller 2. Thus the sealing faces 21 of the lateral cheeks 7 and 8 conform closely to the shape of the surface of the screen roller 2.

The lateral cheeks 7 and 8, the work and closing doctor blades 4 and 6 and the depression 9 of the base body 3 cooperate to define an ink reservoir 22 of the chamber doctor blade assembly 1. Within the area of this ink reservoir 22 an interior or inner face 23 or 24 of each of the respective lateral cheeks 7 or 8 is provided with an opening 26 which is facing in the direction of the ink reservoir 22. The sealing face 21 of each of the lateral cheeks 7 and 8 has a depression 27 which acts as a lubricant and sealing pocket. The opening 26 and the depression 27 are connected with each other.

In the first preferred embodiment of the chamber doctor blade assembly, as shown in FIGS. 1 and 2, a cut or slit 28 or 29 through the sealing faces 21 of the lateral cheeks 7 and 8 is provided. This cut or slit 28 or 29 is used as the depression 27 and opening 26 at the same time. This cut or slit 28 or 29 is generally U-shaped in cross-section and is of a width b28 of, for example, 0.25 mm, and a depth t28 of, for example, 14 mm, and extends across the entire thickness b7 of the lateral cheeks 7 or 8. In addition, together with the interior face 23 or 24 of the lateral cheeks 7 or 8 facing the ink reservoir 22, the cut 28 or 29 can form an opening angle $\alpha$ of, for example, 45°, pointing in the direction of rotation of the screen roller 2.

Figure 3:
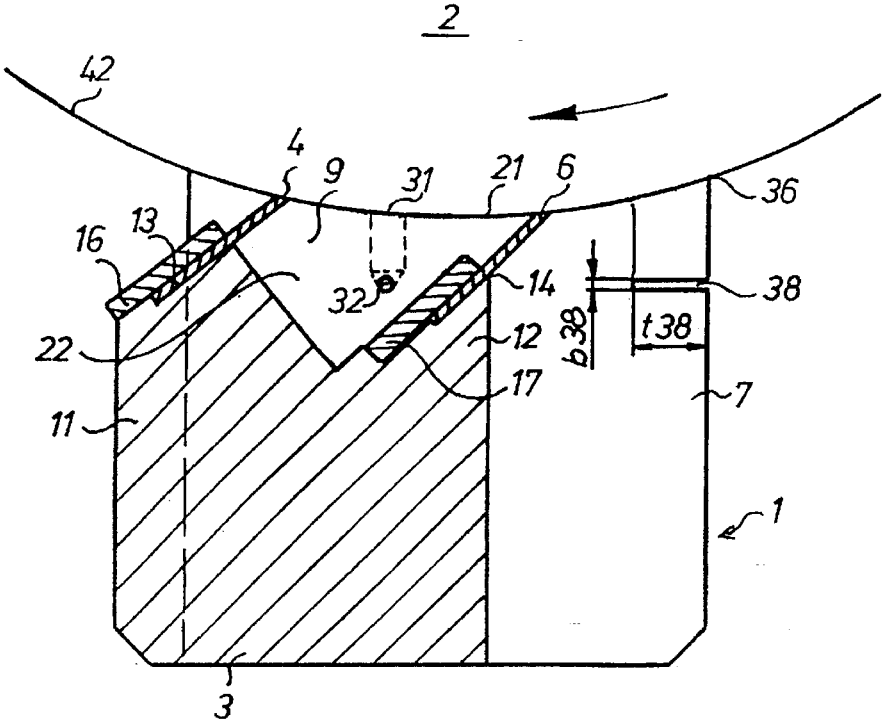
FIG. 3 is a side elevation view, partly in section, of a second preferred embodiment of a chamber doctor blade assembly in accordance with the present invention.
Figure 4:
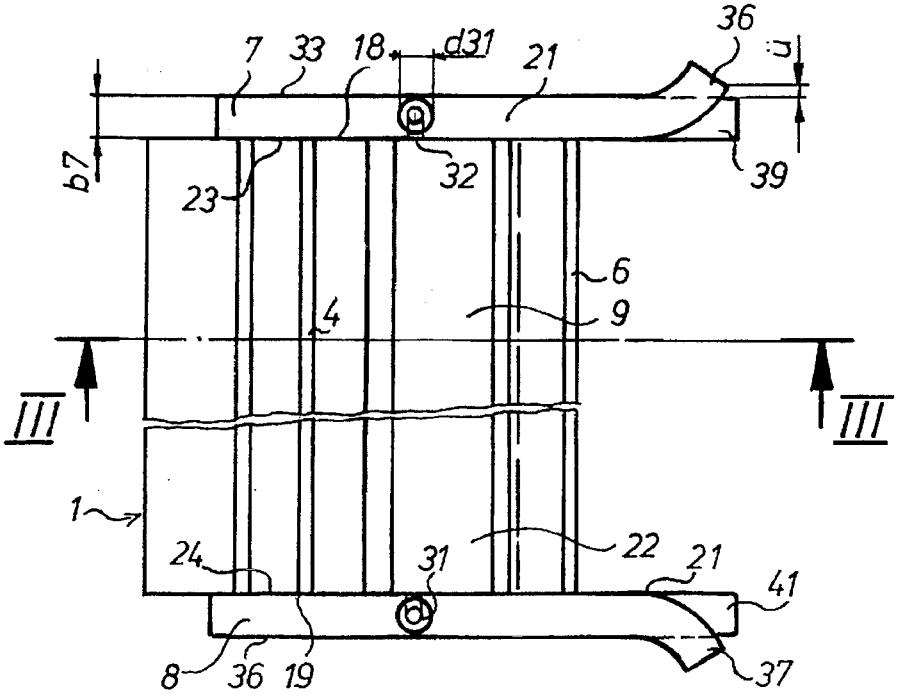
FIG. 4 is a top plan view of the chamber doctor blade assembly of FIG. 3.

In a second preferred embodiment of the chamber doctor blade assembly in accordance with the present invention, as may be seen in FIGS. 3 and 4, the depression 27 in the sealing face 21 of the lateral cheeks 7 and 8 is embodied as a cone-shaped bore 31 which is located centered in respect to the width of the sealing face 21 and whose maximum diameter d31 is, for example, less than the width b7 of the lateral cheeks 7 or 8. The opening 26 from the reservoir 22 is formed as a bore 32 that terminates in the area of the cone tip of the cone-shaped bore 31 and in this way connects the bore 31 with the ink reservoir 22.

Other shapes are, of course, also suitable as depressions 27. For example, cuboid depressions or surfaces ending wedge-shaped in the direction of rotation, and which can be embodied to be limited or open in respect to the inner and outer faces 23 and 24, or 33 and 34 of the lateral cheeks 7 and 8 can be used. In addition, it is also possible to provide several of these depressions 27 and openings 26 along the sealing face 21 of each of the lateral cheeks 7 or 8.

As may be seen, perhaps more clearly in FIGS. 2 and 4, each of the lateral cheeks 7 and 8 is provided with a portion that extends beyond the base body 3 of the chamber doctor blade assembly 1. These wall portions of the lateral cheeks 7 and 8 are generally perpendicular to the axis of rotation of the screen roller 2 and their upper faces, which are essentially extensions of the sealing faces 21, are designated as strippers 36 and 37. These strippers 36 and 37, which are formed in a flared or wedge-shaped manner, are bent or angled and extend laterally past exterior or outer faces 33, 34 of the lateral cheeks 7 and 8 in the direction of rotation of the screen roller 2. In the two preferred embodiments, a cut 38, of a depth t38 and a width b38, extends below and approximately parallel with the sealing face 21 at the inlet end of each of the respective lateral cheeks 7 and 8. By bending a portion of the lateral cheeks 7 and 8 laterally outward, the strippers 36 and 37 are outwardly bent along this cut 38. In other words, the strippers 36 and 37 are bent out in the direction facing away from the ink reservoir 22, in such a way that an interior face 39 or 41 of the strippers 36 or 37 projects past the outer face 34, 36 of the lateral cheeks 7, 8 by a projection u, for example 3 mm. Thus the strippers 36, 37 form a wedge-shaped flare that is tapering with respect to the inner face 23, 24 of the lateral cheeks 7 and 8.

In operation, the chamber doctor blade assembly 1, in accordance with either of the preferred embodiments of the present invention is pressed against the screen roller 2 by a suitable support device that is not shown in the drawings. This causes the sealing faces 21 of the lateral cheeks 7 and 8, and the pre-clamped work and closing doctor blades 4 and 6 to rest against a surface 42 of the screen roller 2. Ink is fed to and is removed from the ink reservoir 22 through suitable openings, which are not shown. The ink contained in the ink reservoir 22 flows through the opening 26 of the front faces 23 or 14 of the lateral cheeks 7 or 8 into the depression 27 of the sealing face 21. The ink is conveyed by the rotation of the screen roller 2 out of the depression 27 into a gap being formed between the sealing face 21 and the screen roller 2. Thus the depression 27 forms a lubricant pocket of a hydrodynamic, or if the ink reservoir 22 is operated under overpressure, of a hydrostatic friction bearing, wherein the ink is used as the lubricant.

If ink exits from the gap between the screen roller 2 and the sealing face 21 and travels outside of the outer faces 33 and 34 of the lateral cheeks 7 and 8, it collects in the form of a bead on the screen roller 2. This bead of ink is conveyed to the inner faces 23 and 24 of the lateral cheeks 7 and 8 by means of the strippers 36 and 37. This escaped ink is conveyed along these inner faces 23, 24 to an ink funnel or return reservoir, not shown. In this way, the strippers 36 and 37 insure that any excess ink will be returned to the ink reservoir and will not spray or sling off the screen roller 2.

While preferred embodiments of a chamber doctor blade assembly in accordance with the present invention have been set forth fully and completely hereinabove, it will be apparent to one of skill in the art that a number of changes in, for example, the type of printing press being used, the support for the chamber doctor blade, the drive for the screen roller and the like could be made without departing from the true spirit and scope of the present invention which is accordingly to be limited only by the following claims.

What is claimed is:

1. A chamber doctor blade assembly of an inking unit of a rotary printing press provided with a screen roller comprising:

a base body having upper faces and first and second end faces;

first and second doctor blades secured to said upper faces of said base body and having free ends engageable with a surface of the screen roller;

first and second lateral cheeks secured to said first and second end faces of said base body, said base body, first and second doctor blades and first and second lateral cheeks defining an ink reservoir extending in an axial direction of the screen roller;

a sealing face on each of said first and second lateral cheeks, each said sealing face having a shape adapted to a curvature of the screen roller; and a depression acting as a lubricant pocket in each sealing face of each said lateral cheek, said depression being in fluid communication with said ink reservoir, said depression being formed by a slit-shaped cut extending across said sealing face.

2. The chamber doctor blade assembly in accordance with claim 1 wherein each of said first and second lateral cheeks has an inner face and an outer face and further wherein said slit-shaped cut is inclined with respect to said inner faces at an opening angle in a direction of rotation of the screen roller.

3. The chamber doctor blade assembly of claim 1 wherein each of said first and second lateral cheeks has an inner face and an outer face and further has a stripper extending outside of said ink reservoir, each said stripper having an interior face, each said stripper interior face extending beyond said outer face of a corresponding one of said lateral cheeks, said first and second strippers being disposed inwardly pointing in a direction of rotation of the screen roller.

4. The chamber doctor blade assembly in accordance with claim 3 wherein said first and second strippers are formed as bent portions of said first and second lateral cheeks.

* * * * *